US005303724A

United States Patent [19]

Anzivino

[11] Patent Number: 5,303,724

[45] Date of Patent: Apr. 19, 1994

[54] HEAD COVER WITH BARRETTE ANCHORAGE MEMBER AND BARRETTE

[75] Inventor: Robert A. Anzivino, Somerset, N.J.

[73] Assignee: Love Wigs, Inc. T/A Look of Love International, Piscataway, N.J.

[21] Appl. No.: 919,272

[22] Filed: Jul. 27, 1992

[51] Int. Cl.[5] ..... A45D 8/12

[52] U.S. Cl. ..... 132/278; 132/53; 132/275; 132/279; 2/174

[58] Field of Search ..... 132/53, 54, 105, 201, 132/275, 278, 279; 2/174

[56] References Cited

U.S. PATENT DOCUMENTS

| | | | |
|---|---|---|---|
| 1,367,172 | 2/1921 | Andreson | 132/275 |
| 1,519,107 | 12/1924 | Breslauer | 132/53 |
| 1,713,616 | 5/1929 | Oppenheim | 132/53 |
| 2,040,246 | 5/1956 | Donoher | 132/53 |
| 2,352,529 | 6/1944 | Frankel | 132/275 |
| 2,795,232 | 6/1957 | Klein et al. | 132/275 |
| 3,192,932 | 7/1965 | Hart | 132/275 |
| 3,460,546 | 8/1969 | Abbott | 132/53 |
| 3,694,819 | 10/1972 | Meyer | 132/53 |
| 3,817,260 | 6/1974 | Kleine | 132/275 |
| 3,881,501 | 5/1975 | Kleine | 132/279 |
| 4,492,242 | 1/1985 | Dalton | 132/53 |
| 4,576,189 | 3/1986 | Regina | 132/53 |
| 4,599,749 | 7/1986 | Childs et al. | 132/53 |
| 4,830,029 | 5/1989 | Bird | 132/53 |
| 4,991,607 | 2/1991 | Chen | 132/278 |
| 5,137,037 | 8/1992 | Mochizuki | 132/53 |
| 5,154,196 | 10/1992 | Moffat | 132/275 |

FOREIGN PATENT DOCUMENTS

| | | | |
|---|---|---|---|
| 2117648 | 10/1971 | Fed. Rep. of Germany | 132/53 |
| 2504129 | 8/1976 | Fed. Rep. of Germany | 132/53 |
| 234430 | 5/1928 | United Kingdom | 132/53 |
| 968071 | 8/1964 | United Kingdom | 132/53 |

*Primary Examiner*—Gene Mancene
*Assistant Examiner*—Frank A. LaViola
*Attorney, Agent, or Firm*—Omri M. Behr; Matthew J. McDonald

[57] ABSTRACT

A partial wig has a fabric support to which the hairs of the wig are secured, the support being semi-circular with a diametrical straight edge. A barrette anchorage member comprises a folded over fabric defining a conduit extending along the straight edge of and stitched to the wig support. The conduit receives a spring member of a hair barrette having a base plate to which an ornamental bow is secured and a hair retainer which rotatably latches to the base plate with the spring and anchorage members sandwiched therebetween. The spring member resiliently engages a slot of the retainer, locking the hair of a wearer and the anchorage member in place. Different barrettes may be used with the same wig and anchorage member assembly or different wigs or head covers such as veils with their attached anchorage members may be used with the same or different barrettes in interchangeable relation.

15 Claims, 3 Drawing Sheets

HEAD COVER WITH BARRETTE ANCHORAGE MEMBER AND BARRETTE

BACKGROUND OF THE INVENTION

1. Field of the Invention

This invention relates to anchorage devices for anchoring a head cover, for example a wig, a veil or the like, to the hair of a person with interchangeable hair barrettes.

2. Description of the Prior Art

Hair barrettes are widely known and are available in numerous sizes, shapes and configurations. For example one type of barrette is disclosed in U.S. Pat. No. 4,919,155. Another is disclosed in design U.S. Pat. No. Des. 306,215 which shows a bow ornament attached to a barrette of the kind disclosed in U.S. Pat. No. 4,919,155. U.S. Pat. No. 887,149 also shows a bow ornament attached to a barrette of a different type than that disclosed in U.S. Pat. No. 4,919,155. In the latter barrette, a pin is inserted in hair and latched to hooks on a base member secured to the bow. In the former, a bowed spring member is between a base plate and a hair retainer which is latched to the base plate. The spring member and retainer clamp hair therebetween when the retainer is latched to the base plate. The barrette with the bow attached is attractive, decorative and covers the barrette so that only the decorative bow is observable when worn on the head of a person.

Wigs, either full or partial, sometimes referred to as hairpieces or switches, are also in wide use. For example, U.S. Pat. No. 578,623 discloses hair switches. The hair is secured to a base so that the base is not visible from the front. At the upper end of the switch one or more loops are attached to the base for receiving a hair pin or comb to attach the switch to a person's hair. However, the loops when used with hair pins or combs are readily observable. The loops are not disclosed as being useful with barrettes of the type described above. If so used the switch would tend to displace along the barrette, be somewhat loose and this looseness would be readily noticeable even if used with a bow decoration. This is not desirable. Further, barrettes with bow decorations are presently used with wigs, especially partial wigs. In this construction, the wigs are permanently fixed to the barrette by stitches or by glue. The wigs are permanently fixed to the barrette to avoid the problem of undesirable looseness discussed above.

Other wig structures are disclosed in U.S. Pat. Nos. 4,830,029; 320,928; 513,579; 1,187,244; 2,651,310; 3,485,249; 4,155,370; 320,928 and 431,892. These suffer from similar drawbacks as discussed above. For example, U.S. Pat. No. 320,928 discloses a fastener sewn to the wig and U.S. Pat. Nos. 3,485,249 and 2,651,310 show combs or other fasteners attached to the wigs.

The present inventor recognizes a need for a device for releaseably securing hair barrettes to wigs or other head covers in a secure manner so that there is no relative movement of the wig or head cover when the barrette is secured to a person's hair. A need is seen also to permit a change of decorative barrettes with the same wig structure or to provide different head coverings with a single barrette in which there is no relative movement between the head covering and barrette while providing ease of interchangeability.

SUMMARY OF THE INVENTION

In accordance with an embodiment of the present invention, a head cover includes a barrette anchorage member for securing the head cover to hair with a barrette. The barrette includes at least a base plate and a hair retainer each having opposing ends, the hair retainer being hinged to the base plate at a first end and releaseably latched to the base plate at a second end distal the first end. The retainer releasably secures hair to which the barrette is to be secured between the base plate and retainer. The head cover comprises cover means for releasable placement over hair. A barrette anchorage member is secured to the head cover means, the member defining an opening therein, the opening being dimensioned for releaseably receiving at least one of the base plate and retainer therethrough such that each opposing end of the at least one received base plate and retainer protrudes from the member for attachment to the other of the base plate and retainer at the opposing ends. The member is further dimensioned relative to the dimensions of said barrette so that the member is secured in substantially fixed relation to the barrette and the anchorage member is substantially immobile relative to the barrette in the latched state of the barrette.

In accordance with a preferred embodiment, the member is a sleeve, the opening comprising a conduit through the sleeve, the conduit being dimensioned to receive the at least one received base plate and retainer, the barrette clamping the sleeve thereto when latched.

In accordance with a still further embodiment, the sleeve is a fabric and of such thickness so as to not interfere with the latching of the barrette.

DESCRIPTION OF THE PREFERRED EMBODIMENTS

Figure 1:
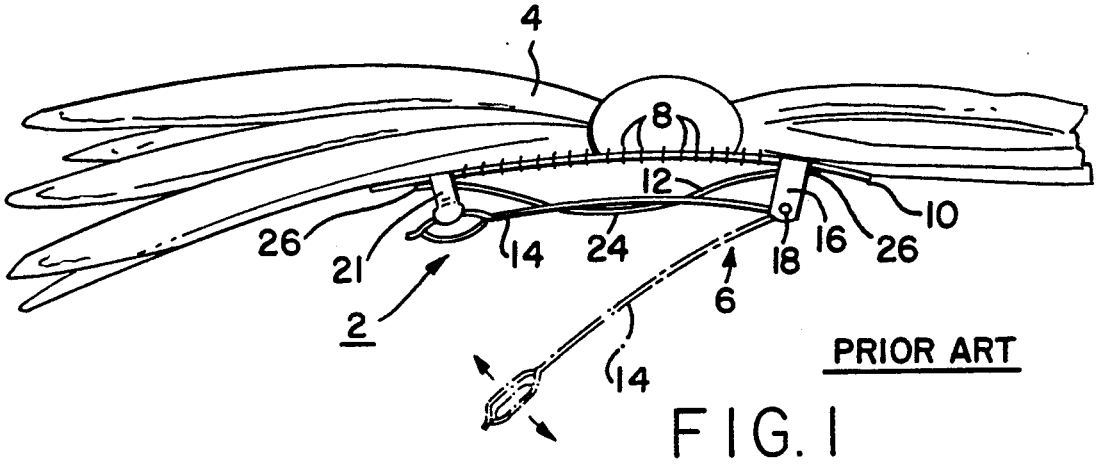
FIG. 1 is a side elevation view of a prior art barrette and decorative bow.
Figure 2:
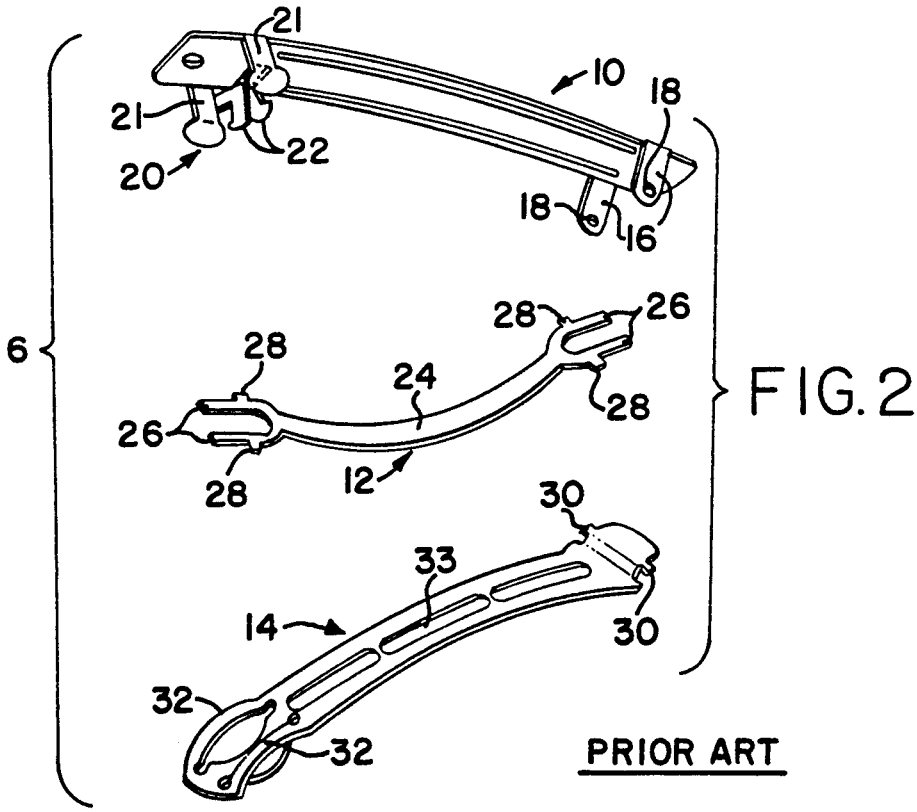
FIG. 2 is an exploded view of the barrette of FIG. 1.

In FIGS. 1 and 2, barrette assembly 2 comprises a decorative fabric bow 4 stitched to barrette 6 via stitches 8. In the alternative to stitches, the bow may be glued or otherwise secured to the barrette in a somewhat permanent manner. The assembly 2 is of the type disclosed in U.S. Pat. No. Des. 306,215 and the barrette 6 may also be as disclosed in U.S. Pat. No. 4,919,155, both incorporated by reference herein. The barrette 6 comprises a base plate 10 formed of stamped sheet metal as are the remaining portions of the barrette, a spring member 12 and a hair retainer 14. The base plate 10 has at one end a pair of upstanding lugs 16 each having a journal 18. At the plate other end is a latch mechanism 20 comprising a pair of upstanding lugs 21 from which hooks 22 are formed. Squeezing the lugs together squeezes the hooks 22 together.

Spring member 12 comprises a bowed central portion 24 and bifurcated tines 26 at each end. Stops 28 project from the tines laterally. The tines 26 at one end are releasably inserted between lugs 16 and the tines 26 at the other end are inserted between lugs 21. The bowed portion 24 extends away from plate 10. Stops 28 abut the lugs 16 at one end and lugs 21 at the other end to limit the compression range of the spring member 12 in a direction toward plate 10.

The hair retainer 14 has a pair of opposing bearing projections 30 at one end of the retainer which projections mate with and engage journals 18 which rotatably receive a different one of the projections 30. This provides a hinge for the retainer to rotate relative to the plate 10 and spring member 12. The other opposing end of retainer 14 has a pair of spaced latch members 32 which resiliently engage and lock to hooks 22 in the latched state. When the lugs 21 of plate 10 are squeezed together, the hooks 22 disengage from the latch members 32 releasing the retainer for rotation about journals 18 as shown in phantom, FIG. 1. An elongated slot 33 is formed in retainer 14 and positioned centrally therein between the retainer ends. Slot 33 has a width slightly greater than the width of the spring member bowed portion 24. In the latched state, the retainer abuts the bowed portion 24 of the member 12 so that the portion 24 fits into and passes through the slot 33. At the same time the portion 24 is compressed somewhat by the retainer 14 when latched. Normally, in the prior art use, hair between the portion 24 and the retainer central portion is clamped by these elements.

Figure 3:
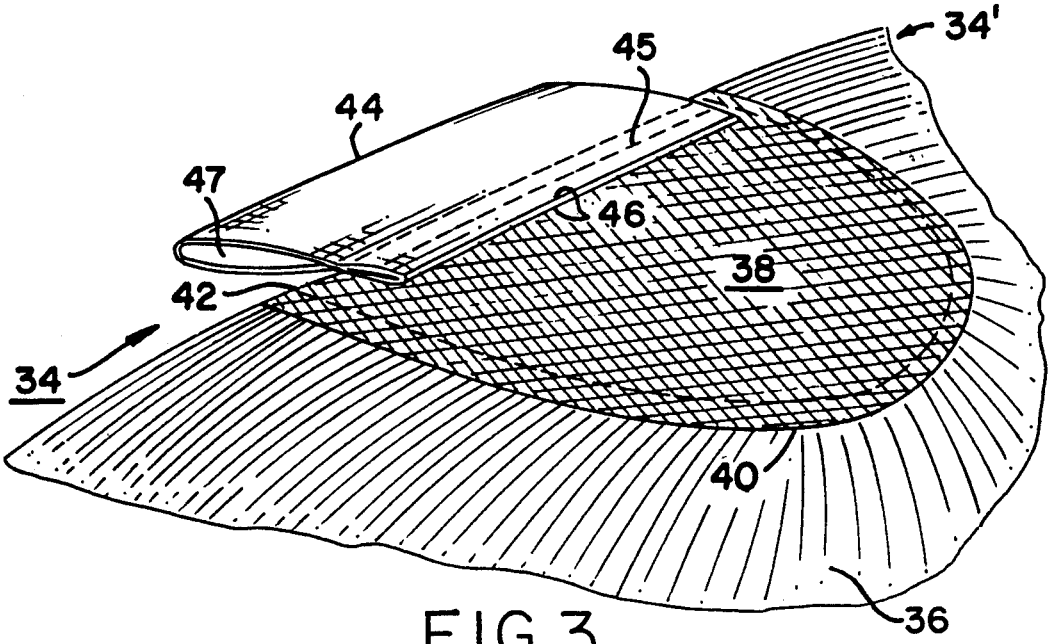
FIG. 3 is an isometric view of a partial wig including an anchorage member in accordance with one embodiment of the present invention.

In FIG. 3, a partial wig 34 in accordance with an embodiment of the present invention comprises a conventional hairpiece 34' which includes hair strands secured to a fabric support 38. The support is semi-circular, the hair strands being sewn about the circular edge 40 of the support 38. The diametrical straight edge 42 of the support 38 is aligned with an edge of the wig 34. Secured to hairpiece 34' is a barrette anchorage member 44.

Figure 3A:
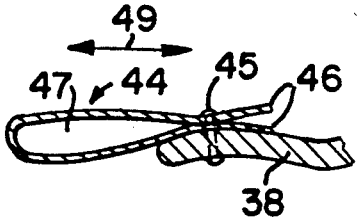
FIG. 3*a* is a side elevation view of the anchorage member of FIG. 3.
Figure 6:
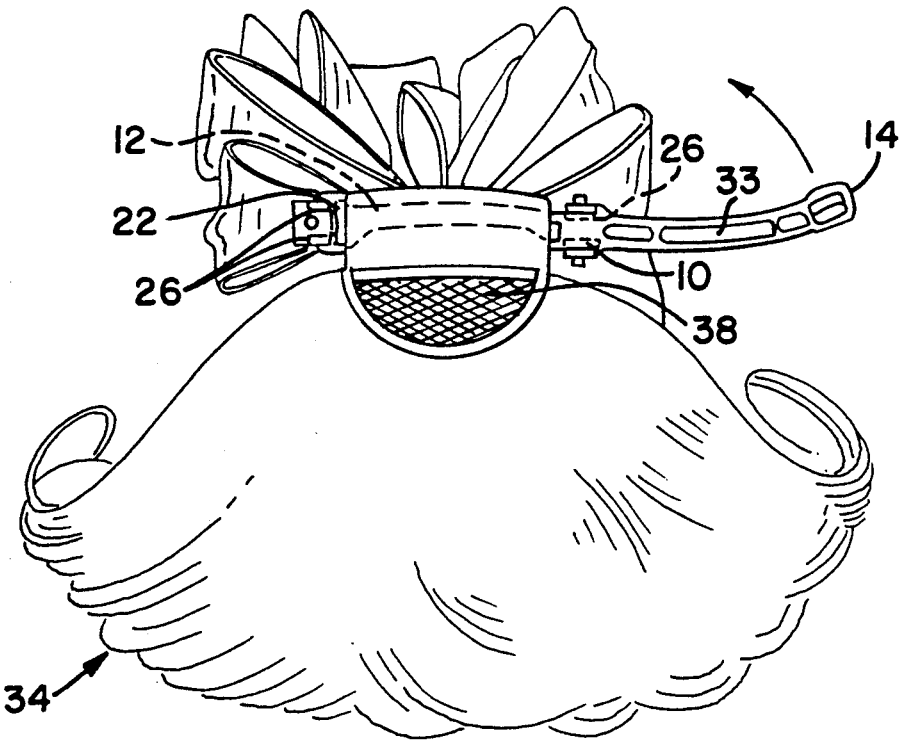

Anchorage member 44 comprises a relatively thin fabric, for example a satin like material or other light weight fabric or synthetic material such as high strength plastic sheet material and so one. The fabric is formed into an elongated sleeve having a flattened configuration as shown. The member 44 is formed by sewing or otherwise fastening it adjacent to its edges 46 to the wig support 38 via stitches 45. The length dimension of the member 44 is parallel to the edge 42 of the support 38. The length dimension of the member 44 is sufficient to fit between the lugs 16 and 21 of the base plate 10 and extends to approximate abutting relation with these lugs when disposed therebetween. The width dimension of the member 44 opening 47 in the transverse direction 49, FIG. 3*a*, is just sufficient to receive the spring member tines 26 and stops 28 therethrough. The tines and stops extend beyond the member 44 at opposing ends thereof as shown in FIG. 6 when the spring member is inserted in the opening 47 of the anchorage member 44. The length of the member 44 is preferably as great as the distance between the lugs 16 and 21, and more than 50 per cent of the length of the barrette. Preferably, the anchorage member 44, the fabric support 38 of the wig and the hair of the wig are about the same color.

Figure 4:
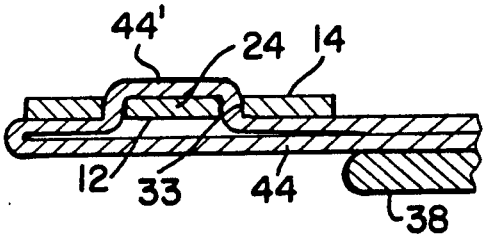
FIG. 4 is a transverse partial sectional view through the barrette of FIG. 1 as attached to the anchorage member of FIG. 3*a*.
Figure 5:
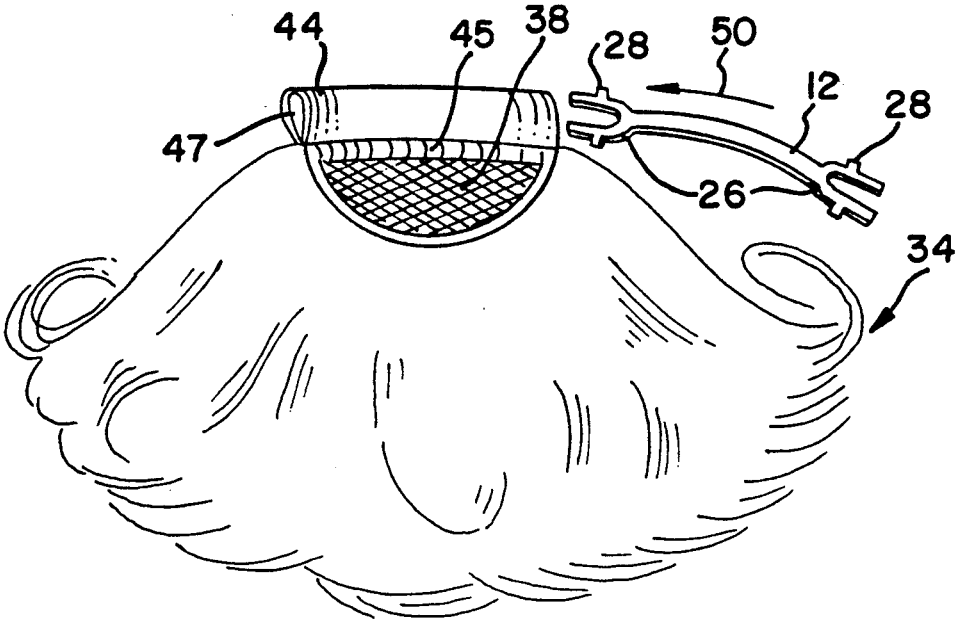
FIGS. 5 and 6 illustrate assembly sequences for attaching the barrette of FIG. 1 to the partial wig and anchorage member of FIG. 3.

In FIG. 5, the spring member 12 is shown about to be inserted into the opening of the sleeve of anchorage member 44 in direction 50. The bowed portion of the spring member 12 is inserted to face the hair of the wearer when the barrette is attached to the wearer's hair. After the spring member is so inserted, the wig and spring member are attached releaseably to the barrette by insertion of the tines 26 between the lugs of the base plate 10 as described. The wearer then places their own hair between the anchorage member 44 and the retainer, latching the retainer to the position shown in solid line from the position shown in phantom in FIG. 1 (the hair of the user not being shown in this figure). In FIG. 4, the fabric material of the member 44 is shown sufficiently thin so as to not interfere with the insertion of the central portion 24 of the spring member 12 into the slot 33 of the retainer 14. In this Figure, the hair of the wearer is not shown for purposes of illustration. The action described is important because by inserting the fabric of the anchorage member between the edges of the retainer opening 33 and spring member 12 a clutch-like action takes place providing enhanced locking action of the wearer's hair, member 44 and retainer 18. If the fabric of the member 44 were too thick, then slippage of the hair of the wearer might occur which is undesirable. That is, the interlocking action of the spring member 12 and retainer 14 is maintained in the presence of anchorage member 44 by employing thin material for the anchorage member.

Figure 7:
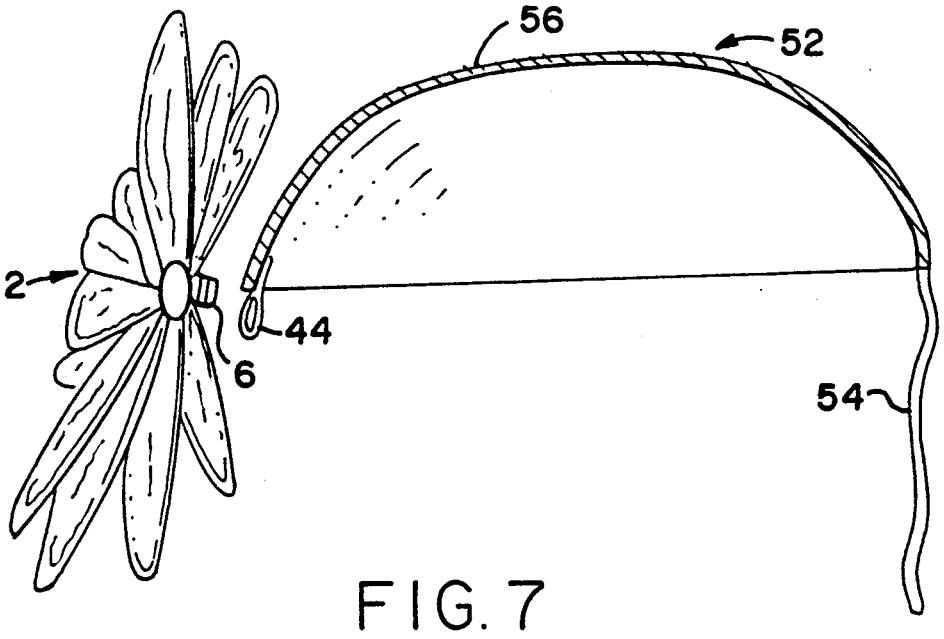

In FIG. 7, in an alternative embodiment, instead of a wig, the head cover may be a veil assembly 52 comprising a veil 54 and a hat portion 56. In veils of this type the hat portion may be relatively small and additional fasteners may be needed. In this case, an anchorage member 44 is sewn to the rear of the hat portion. The barrette assembly 2, FIG. 1, is then attached to the anchorage member and then to the hair of the wearer. Other head covers of fabrics, hats and so on may be so attached to an anchorage member 44 to provide attractive attachment to a wearer.

While a particular type of barrette is disclosed, it should be apparent that other types of barrettes without the spring member 12 may be used with the anchorage member 44. In this case the hair pin portion which normally is inserted into the hair of the wearer as disclosed in U.S. Pat. No. 887,149 is inserted into the conduit-like opening of the member 44 and the hair clamped between the base plate of the barrette and the hair pin portion encased in the member 44. Depending upon a given implementation, the base plate of the barrette may also be inserted into the anchorage member 44 opening 47. Barrettes may be used with many different types of decorative objects secured to the base plate thereof in a known way.

What is claimed is:

1. A device including a head cover with barrette anchorage member for securing the head cover to hair with a barrette, the device comprising:

a barrette including at least a base plate and a hair retainer each having opposing ends, said hair retainer being hinged to the base plate at a first end and releasably latched to the base plate at a second end distal the first end, said retainer releasably securing hair to which the barrette is to be secured between the base plate and retainer;

cover means for releasable placement over hair; and a barrette anchorage member comprising a sleeve having opposing ends and secured to said head cover means, said member defining an elongated opening therein in communication with said ends, said opening being dimensioned for releasably receiving at least one of said base plate and retainer therethrough such that each opposing end of the at least one received base plate and retainer protrudes from the member for attachment to the other of said base plate and retainer at said opposing ends, said member being further dimensioned relative to the dimensions of said barrette so that said member is secured in substantially fixed relation to said barrette and the anchorage member is substantially immobile relative to the barrette in the latched state of the barrette, said opening comprising a conduit through the sleeve, said conduit being dimensioned to receive the at least one received base plate and retainer, the barrette clamping the sleeve thereto when latched.

2. The device of claim 1 wherein the sleeve is an elongated fabric having a thickness sufficiently thin so as to not interfere with the latching of the barrette.

3. The device of claim 1 wherein the head cover means comprises a hair piece having a plurality of strands of hair secured to a support, said anchorage member being secured to said support.

4. The device of claim 1 wherein the head cover means includes a fabric portion, said sleeve comprising a fabric attached to the fabric portion.

5. A device including a head cover with barrette anchorage member for securing the head cover to hair with a barrette, the device comprising:

a barrette having first and second opposing ends and including a base plate, a spring having opposing ends and a hair retainer, said hair retainer being hinged to the base plate at a first end and releasably latched to the base plate at a second end distal the first end, said spring being releasably secured between the base plate and retainer for releasably resiliently securing hair to which the barrette is to be secured between the spring and retainer;

cover means adapted to be placed on the head of a person and including a support; and a barrette anchorage member comprising a sleeve secured to said support, said sleeve having opposing ends and defining an opening therein in communication with said ends, said opening receiving one of said spring and retainer therethrough such that each opposing end of the received one spring and retainer protrudes from the sleeve for attachment to said base plate.

6. The device of claim 5 wherein said cover means includes a plurality of strands of hair secured to said support to form a hairpiece.

7. The device of claim 5 wherein said sleeve comprises sheet material folded over in over lapping relation and attached to said support.

8. A device including a hairpiece with a barrette anchorage member for securing the hairpiece to hair with a barrette, the device comprising:

a barrette having first and second opposing ends and including a base plate, a spring having opposing ends and a hair retainer, said hair retainer being hinged to the base plate at a first end and releasably latched to the base plate at a second end distal the first end, said spring being releasably secured between the base plate and retainer at each said first and second opposing ends for releasably resiliently securing hair to which the barrette is to be secured between the spring and retainer;

a support and a plurality of strands of hair secured to the support; and a barrette anchorage member comprising a sleeve defining a conduit in communication with opposing sleeve ends and secured to said support, said conduit receiving one of said spring and retainer therethrough such that each opposing end of the received one spring and retainer protrudes from a corresponding opposing end of the sleeve for attachment to said base plate whereby the sleeve is secured to the latched retainer.

9. The device of claim 8 wherein the spring comprises a bent sheet metal member having a given width, said retainer having a slot adapted to mate with said spring width for locking the spring to the retainer in a direction transverse a direction extending through said ends, said sleeve having a thickness sufficiently thin to permit said spring to engage and lock with said retainer slot.

10. The device of claim 8 wherein the spring is normally bowed and is resiliently compressed when the retainer is latched.

11. The device of claim 8 wherein the support is a fabric and the sleeve is a fabric sewn to the support.

12. The device of claim 8 wherein the support is a semi-circular fabric having a semi-circular edge and a diametric edge, the strands of hair extending from the semi-circular edge, the anchorage member being secured to the support at and extending from said diametric edge.

13. The device of claim 8 wherein the support has an edge, said anchorage member extending from said edge with the conduit parallel to said edge.

14. The device of claim 8 wherein the barrette has a length dimension between said first and second ends, said anchorage member has a length greater than 50 per cent of the length of said barrette between said first and second ends.

15. The device of claim 8 wherein the hair, anchorage member and support have about the same color.

* * * * *